United States Patent [19]

Hattori et al.

[11] 4,364,306

[45] Dec. 21, 1982

[54] SWASH PLATE TYPE COMPRESSOR

[75] Inventors: Mitsuhiro Hattori; Tomoo Fujii; Hiroya Kono, all of Kariya, Japan

[73] Assignee: Kabushiki Kaisha Toyoda Jidoshokki Seisakusho, Aichi, Japan

[21] Appl. No.: 102,997

[22] Filed: Dec. 12, 1979

[30] Foreign Application Priority Data

Dec. 30, 1978 [JP] Japan ..... 53-179244[U]

[51] Int. Cl.[3] ..... F04B 1/16; F01B 3/02

[52] U.S. Cl. ..... 92/71; 417/269; 74/60

[58] Field of Search ..... 417/269; 92/71; 74/60; 123/58 BA

[56] References Cited

U.S. PATENT DOCUMENTS

| | | | |
|---|---|---|---|
| 1,978,762 | 10/1934 | Reagan | 74/60 |
| 3,057,545 | 10/1962 | Ransom | 417/269 |
| 3,215,341 | 11/1965 | Francis | 417/269 |
| 3,319,878 | 5/1967 | Steinhagen et al. | 417/269 |
| 3,577,891 | 11/1971 | Namoto | 417/269 |
| 3,930,758 | 1/1976 | Park | 417/269 |
| 3,939,717 | 2/1976 | Roesdahl | 417/269 |
| 3,951,569 | 4/1976 | Jacobs | 417/269 |

FOREIGN PATENT DOCUMENTS

| | | | |
|---|---|---|---|
| 593962 | 3/1960 | Canada | 417/269 |
| 2109616 | 10/1971 | Fed. Rep. of Germany | 417/269 |
| 2151128 | 5/1972 | Fed. Rep. of Germany | 417/269 |
| 302658 | 12/1928 | United Kingdom | 91/502 |

*Primary Examiner*—William L. Freeh

*Attorney, Agent, or Firm*—Burgess, Ryan and Wayne

[57] ABSTRACT

A swash plate type compressor, in which there is incorporated a plurality of double-headed compressor pistons, each being formed with an axially central recess between two heads thereof. Inside the recess a generally outer part of the swash plate is arranged so as to establish an operative connection between each piston and the swash plate. The axially central recess has a bottom surface a part of which protrudes toward an outer surface of the swash plate. The protruding part serves to restrict a rotation of each piston about its own axis to a given small amount. The protruding part has an axial length determined so that when each compressor piston approaches one of the two compression dead centers, an outer edge of the swash plate comes away from the protruding part.

6 Claims, 11 Drawing Figures

SWASH PLATE TYPE COMPRESSOR

FIELD OF THE INVENTION

The present invention relates to a swash plate type compressor and, in particular, to an improved structure of the pistons incorporated into a swash plate type compressor for the purpose of heightening the performance of the compressor and prolonging the durability of the compressor.

BACKGROUND OF THE INVENTION

U.S. Pat. No. 4,070,136 discloses a conventional swash plate type compressor having a pair of horizontal axially aligned cylinder blocks which form a combined cylinder. Inside the combined cylinder are formed axially extending cylinder bores, and the combined cylinder is closed at both ends by front and rear housings, via valve plates. Centrally passing through the combined block, a drive shaft is rotatably supported by a suitable bearing means. To the middle of the drive shaft is fixed a swash plate operatively connected to, via ball bearings and shoes, double headed pistons slidably fitted in the cylinder bores. Thus, the rotating of the swash plate causes the reciprocal compressing motion of the pistons within the cylinder bores. The front and rear housings have refrigerant suction chambers and refrigerant discharge chambers, which are interconnected with the cylinder bores and are connectable to an outside air conditioning system by means of appropriate refrigerant flow pipelines. The above-mentioned conventional compressor has therein such an internal arrangement that while the double headed pistons reciprocate in the cylinder bores, the rotating motion of each double headed piston about its own axis is stopped by the swash plate. More specifically, the double headed pistons are arranged adjacent to the radially outward part of the swash plate with respect to the axis of rotation of the swash plate. Therefore, if each double headed piston rotates about its own axis, a part of each piston abuts against the cylindrical outer surface of the swash plate. As a result, a further rotation of each piston is prevented by the cylindrical outer surface of the swash plate. At this stage, a very small amount of space is provided between each piston and the cylindrical outer surface of the swash plate so that the generation of noisy sounds by the above-mentioned abuting motion of each piston is limited to the lowest possible level. However, the very small amount of space provided between each piston and the cylindrical outer surface of the swash plate has shown diverse defects, as described later with reference to the accompanying drawings, from the point of view of performance and durability of the swash plate type compressor.

SUMMARY OF THE INVENTION

An object of the present invention is to provide a novel structure of a double headed piston for use in a swash plate type compressor, which is an improvement over the conventional structure of the piston so as to eliminate all defects encountered by the conventional swash-plate type compressor.

Another object of the present invention is to provide a swash plate type compressor having a high performance and a long durability.

These and other objects, features, and advantages of the present invention will be made more apparent from the ensuing description with reference being made to the accompanying drawings wherein.

Figure 1:
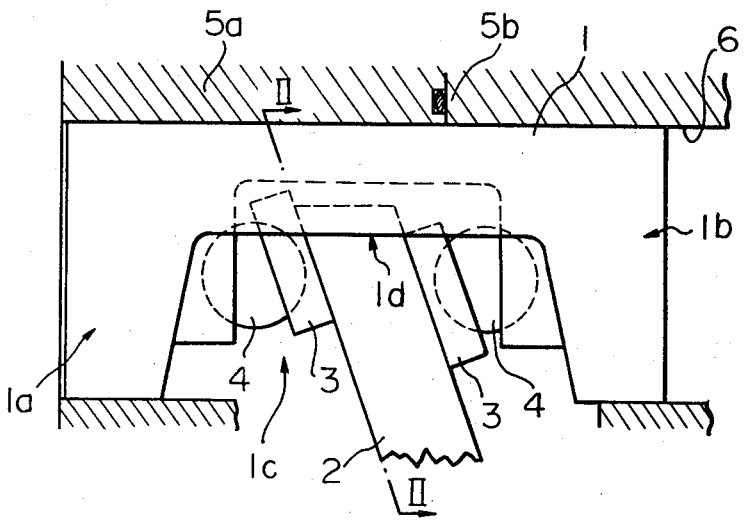
FIG. 1 is a partial front view illustrating the operative connection between one piston and a swash plate of the conventional swash plate type compressor.
Figure 2:
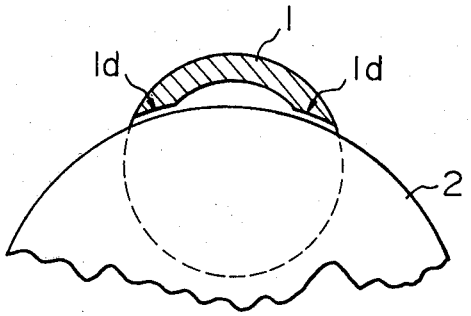
FIG. 2 is a schematic cross-sectional view taken along line II—II of FIG. 1.

Referring to FIG. 1, a double headed piston 1 of the conventional swash plate type compressor is formed with two piston heads 1*a* and 1*b*, and slidably fitted in a cylinder bore 6 which is formed in a pair of cylinder blocks 5*a* and 5*b*. The double headed piston 1 is provided with an axially central recess 1*c*, the opening of which is arranged on the radially inner side of the piston 1 with respect to the axis of rotation of a swash plate 2. Inside the recess 1*c*, the piston 1 is operatively connected to the swash plate 2, via shoes 3 and ball bearings 4. Therefore, the rotating motion of the swash plate 2 causes an axially reciprocating motion of the piston 1 within the cylinder for effecting compression of a fluid. The piston 1 has a generally cylindrical configuration, and accordingly, the piston 1 per se is rotatable about its own axis within the cylinder bore 6. However, since a part of the bottom face 1*d* of the recessed portion of the piston 1 is arranged adjacent to and outside the cylindrical outer surface of the swash plate 2, as illustrated in FIG. 2, the rotating motion of the piston 1 about its own axis is restricted due to the abutting of part of the bottom face 1*d* against the outer surface of the swash plate 2. At this stage, it should be noted that the clearance left between part of the bottom face 1*d* and the cylindrical outer surface of the swash plate 2 is kept very small for preventing the generation of a noisy sound by the abutment of the piston 2 against the swash plate 2. Further, as is illustrated in FIGS. 1 and 2, the part of the bottom face 1*d* of the recessed portion of the piston 2 axially extends straight on both sides of the center of the piston 2. This is for the purpose of permitting the swash plate 2 to change its axial position within the recessed portion of the piston 1 in response to the rotation of the swash plate 2. However, diverse defects described hereinbelow with reference to FIGS. 3 and 4 are encountered by the piston 1 of the conventional swash plate type compressor.

Figure 3:
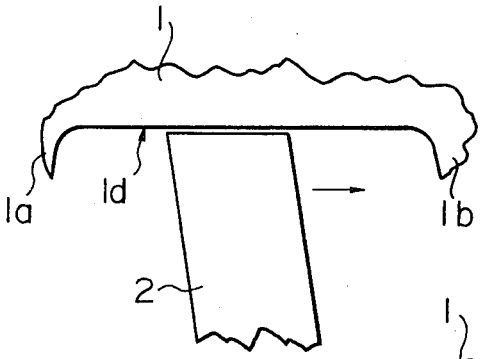
FIGS. 3 and 4 are explanatory views illustrating the operation of the piston and the swash plate of the conventional swash plate type compressor.
Figure 4:
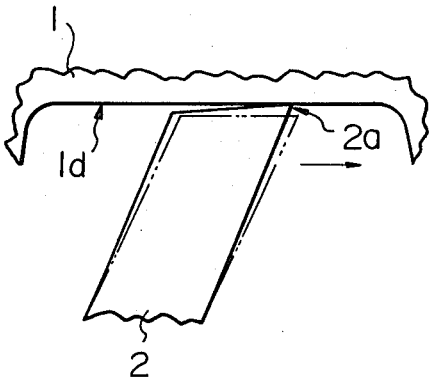

Referring to FIGS. 3 and 4, when the fluid is compressed in the cylinder bore located on the right side of the piston head 1*b*, the pressure of the fluid gradually rises while the piston 2 approaches the rightmost end of its compression stroke. This rise in the pressure of the compressed fluid acts on the swash plate 2, via the piston 1, the shoes 3 and the ball bearings 4 (FIG. 1). As a result, the swash plate 2 is slightly bent by the force of the pressure. That is, the swash plate 2 is outwardly deflected from the normal position thereof indicated by the broken line in FIG. 4 to the position indicated by the solid line in FIG. 4. Accordingly, an acute-angled edge 2*a* of the swash plate 2 is pressed against the bottom face 1*d* of the piston 1 while the swash plate 2 is rotating to cause the compression of the piston 1. Consequently, the piston 1 is in turn pressed against the wall of the cylinder bore 6 (FIG. 1) during the sliding compression thereof. Therefore, the piston 1 per se slides in the cylinder bore 6 (FIG. 1) while overcoming a considerably large friction force which acts between the cylindrical outer surface of the piston 1 and the wall of the cylinder bore. As a result, the sliding portion of the piston 1 and the cylinder bore 6 (FIG. 1) gradually wear out. Moreover, there is often the case where the piston 1 seizes up due to the effect of the high friction temperature. At this stage, it should be noted that the above-mentioned deflection of the swash plate 2, which causes the pressing of the piston 1 against the wall of the cylinder bore, also causes an outward bending of the piston 1 since the bottom face 1*d* of the recessed portion of the piston 1 is pressed by the deflected swash plate 2. This outward bending of the piston 1 not only prevents the smooth sliding of the piston 1 but also accelerates the wear of the sliding portion of the piston 1 and the cylinder bore. It should further be noted that even though there is usually provided a given amount of clearance between the piston 1 and the cylinder bore, this clearance is very small and does not compensate for the deflection of the swash plate 2. Therefore, the conventional swash plate compressor must always involve the above-mentioned defects of the wearing of the sliding portion and of the seizure of the pistons.

The present invention, an object of which is to eliminate the defects of the conventional swash plate type compressor, will now be explained hereinafter with reference to FIGS. 5 through 10.

Figure 5:
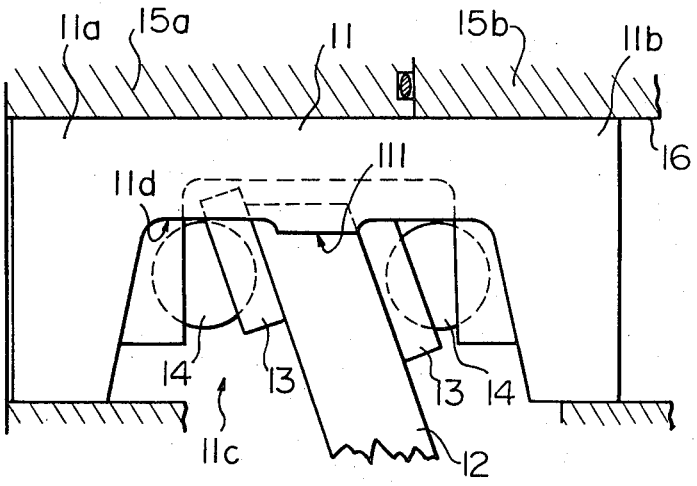
FIG. 5 is a view similar to that of FIG. 1, but illustrating the structure of one piston incorporated into a swash plate type compressor, according to an embodiment of the present invention.
Figure 6:
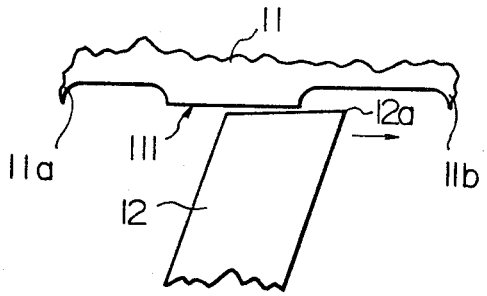
FIG. 6 is an explanatory view illustrating the operation of the piston and the swash plate of FIG. 5.

Referring firstly to FIGS. 5 and 6, there is illustrated one of the pistons 11 incorporated into a swash plate type compressor according to an embodiment of the present invention. The piston 11 is provided with two piston heads 11*a* and 11*b* axially distant from one another, and a central recess 11*c* between the two heads. The piston 11 is slidably fitted within the corresponding cylinder bore 16 formed in a pair of cylinder blocks 15*a* and 15*b* axially connected to one another. Inside the recess 11*c*, the piston 11 is operatively connected to the swash plate 12, via shoes 13 and ball bearings 14. Thus, the piston 11 performs a reciprocatory compressing motion in the cylinder bore 16 in response to the rotating motion of the swash plate 12. The recess 11*c* of the piston 11 is formed with a bottom face 11*d*, the central part of which protrudes toward the cylindrical outer surface of the swash plate 12. The protruding part is denoted by reference numeral 111 in FIGS. 5 and 6. Between the face of the protruding part 111 and the cylindrical outer surface of the swash plate 12, there is provided a limited small amount of space. The axial length of the protruding part 111 is determined so that when the piston 11 within the cylinder bore 16 approaches one of the two extreme positions, of the piston referred to as compression dead centers, where the piston 11 changes its direction of the reciprocatory compressing motion, an acute-angled edge 12*a* of the swash plate 12 which also approaches one of the two extreme positions of the piston, comes away from the protruding part 111 of the piston 11, as illustrated in FIG. 6.

When a swash plate type compressor incorporating therein a plurality of the above-mentioned pistons 11 is operated, and when the pistons 11 reciprocate in the corresponding cylinder bores in response to the rotation of the swash plate 12, the protruding part 111 of each piston 11 acts so as to permit only a limited amount of rotation of said each piston about its own axis. This is because if each piston 11 rotates about its own axis during the reciprocatory compression, the protruding part 111 abuts against the cylindrical outer surface of the swash plate 12, whereby the rotating motion of said each piston 11 is stopped. However, when one of the two piston heads 11*a* and 11*b* approaches its compression dead center, an acute-angled edge 12*a* of the swash plate 12 is positioned outside the protruding part 111 of the piston 11, as illustrated in FIG. 6. Therefore, if the swash plate 12 is outwardly deflected by the pressure of a compressed fluid, the acute-angled edge 12*a* does not touch the piston 11. As a result, each piston 11 is neither outwardly pressed by the swash plate 12 against the wall of the corresponding cylinder bore nor is any part of the bottom face 11*d* of each piston 11 scraped by the acute-angled edge of the swash plate 12. Accordingly, neither the wear of the sliding portion of the pistons 11 and the corresponding cylinder bores nor the seizure of the portions occurs. Further, since there is always provided a limited small amount of clearance between the bottom face 11*d* of each piston 11 and the cylindrical outer surface of the swash plate 12, the bending of each piston 11 does not occur. Therefore, the pistons 11 slide more easily within the cylinder bores. Consequently, the power for driving the swash plate type compressor can be smaller than that for driving the conventional compressor. In addition, in the case where the piston 11 is manufactured by a casting method, no portion of the recessed portion of each piston other than the face of the protruding part 111 requires a finishing process employing a machine tool. As a result, the manufacturing of the piston 11 is easier. Further, since the larger portion of the recessed portion of each piston 11 is not subjected to a finish machining process, said larger portion includes a chilled layer which is generated during the casting process of each piston 11. It should be noted that the chilled layer is considerably resistant to mechanical fatigue. Thus, a strong and reliable piston 11 can be acquired.

Figure 7:
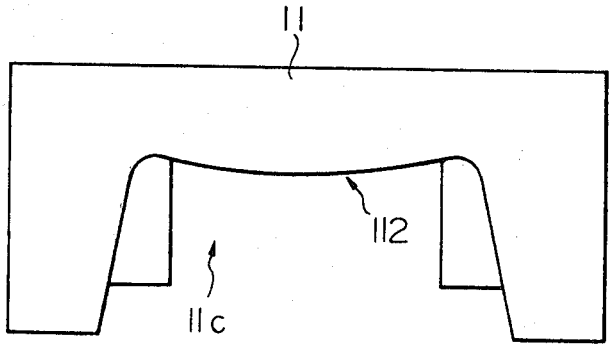
FIG. 7 is a front view of one piston incorporated in the compressor, according to another embodiment of the present invention.
Figure 8:
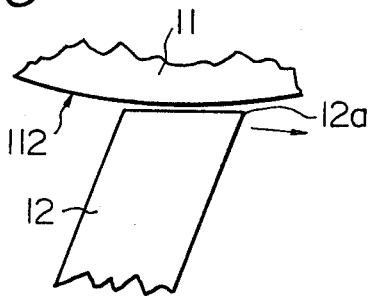
FIG. 8 is an explanatory view illustrating the operation of the piston of FIG. 7 and the cooperating swash plate.

Referring to FIGS. 7 and 8, there is illustrated a piston 11 according to another embodiment of the present invention. In this embodiment, the piston 11 is provided with a protruding part 112 which has a gentle curve. When the piston 11 of FIGS. 7 and 8 is incorporated in a swash plate type compressor, and when the piston 11 approaches one of the extreme positions within the corresponding cylinder bore during the reciprocatory compression, the curved face of the recess 11*c* of the piston 11 can prevent an acute-angled edge 12*a* of a swash plate 12 from being pressed against the protruding part 112 even if the acute-angled edge 12*a* of the swash plate 12 is outwardly deflected by the force of pressure of a compressed fluid. Therefore, the same advantageous effects as those exhibited by the piston 11 of FIGS. 5 and 6 can be acquired.

Figure 9:
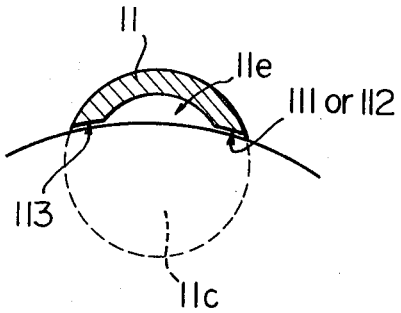
FIGS. 9 through 11 are cross-sectional views of the pistons according to the present invention.
Figure 10:
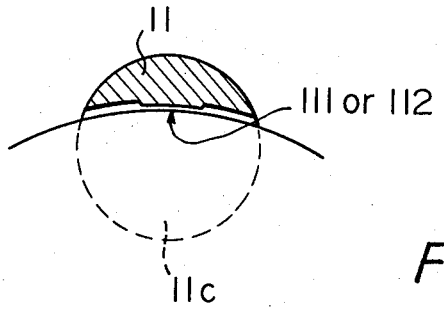
Figure 11:
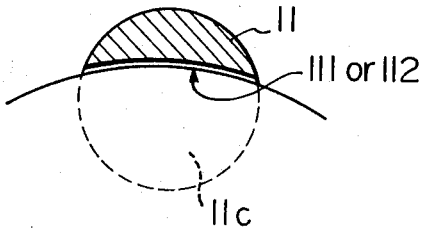

FIGS. 9 through 11 illustrate the diverse cross-sections of the piston 11 having the protruding part 111 or 112. FIG. 9 illustrates the case in which the piston 11 is formed with an axially extending groove 11*e* communicating with the recess 11*c*. The protruding part 111 or 112 is provided on each side of the groove 11*e*. FIG. 10 illustrates the case in which protruding part 111 or 112 of the recessed portion of the piston 11 is arranged at the center of the piston 11. FIG. 11 illustrates the case in which the protruding part 111 or 112 extends transversely to the axis of the piston 11.

From the foregoing description of the embodiments of the present invention, it will be understood that the novel structure of a piston of the present invention ensures a long durability of a swash plate type compressor as well as less power for driving the compressor.

We claim:

1. In a swash plate type compressor comprising a pair of axially connected cylinder blocks having therein a plurality of axially extending cylinder bores, a plurality of double headed compressor pistons slidably fitted in said cylinder bores, a drive shaft axially centrally extending through said cylinder blocks and having thereon a swash plate capable of rotating with said drive shaft for causing a reciprocatory compression of each of said double headed compressor pistons between two compression dead centers, each said double headed piston being formed, between two piston heads thereof, with an axially central recess in which a generally outer part of said swash plate is arranged so as to establish an operative connection between each said piston and said swash plate, the improvement comprising: said axially central recess of each said piston having a bottom surface, a part of which protrudes toward an outer surface of said swash plate, said protruding part being provided as an abutment capable of immediately contacting said outer surface of said swash plate as soon as only a given amount of rotation of each said double headed compressor piston about its own axis occurs during the running of the compressor, said protruding part having its axial length determined so that when each said double headed compressor piston approaches one of said compression dead centers, an outer edge of said generally outer part of said swash plate which also approaches one of said compression dead centers comes away from said protruding part and an inner edge of the generally outer part of the swash plate stays at a position adjacent to the protruding part.

2. A swash plate type compressor as claimed in claim 1, wherein said protruding part of each said double headed compressor piston has an axially extending straight face.

3. A swash plate type compressor as claimed in claim 1, wherein said protruding part of each said double headed compressor piston has a face formed as a gently curved bulged face.

4. A swash plate type compressor as claimed in claim 1, 2 or 3, wherein said axially central protruding part of each said double headed compressor piston has an axially extending groove communicating with said axially extending recess and one said protruding part is provided on either side of said groove.

5. A swash plate type compressor as claimed in claim 1, 2, or 3, wherein said protruding part is located at the center of said piston.

6. A swash plate type compressor as claimed in claim 1, 2, or 3, wherein said protruding part extends transversely to the axis of said piston.

* * * * *